US008907849B2

(12) United States Patent
Rogers et al.

(10) Patent No.: US 8,907,849 B2
(45) Date of Patent: Dec. 9, 2014

(54) WAFER-LEVEL RF TRANSMISSION AND RADIATION DEVICES

(71) Applicant: Harris Corporation, Melbourne, FL (US)

(72) Inventors: John E. Rogers, Vero Beach, FL (US); Ronald E. Jackson, Jr., West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 197 days.

(21) Appl. No.: 13/650,252

(22) Filed: Oct. 12, 2012

(65) Prior Publication Data

US 2014/0104114 A1 Apr. 17, 2014

(51) Int. Cl.
*H01Q 1/38* (2006.01)

(52) U.S. Cl.
USPC ..... 343/700 MS; 343/793; 343/905

(58) Field of Classification Search
USPC ..... 343/700 MS, 793, 905
See application file for complete search history.

(56) References Cited

U.S. PATENT DOCUMENTS

| | | | |
|---|---|---|---|
| 5,025,264 | A | 6/1991 | Stafford |
| 6,587,021 | B1 | 7/2003 | Streeter |
| 6,600,395 | B1 | 7/2003 | Handforth et al. |
| 6,812,718 | B1 | 11/2004 | Chong et al. |
| 6,876,333 | B2 * | 4/2005 | Tasi ..... 343/702 |
| 6,903,687 | B1 * | 6/2005 | Fink et al. ..... 343/700 MS |
| 7,012,489 | B2 | 3/2006 | Sherrer et al. |
| 7,026,899 | B2 | 4/2006 | Adams et al. |
| 7,123,119 | B2 | 10/2006 | Pashby et al. |
| 7,898,356 | B2 | 3/2011 | Sherrer et al. |
| 2004/0066338 | A1 | 4/2004 | Chen et al. |
| 2004/0189530 | A1 | 9/2004 | Chung et al. |

(Continued)

FOREIGN PATENT DOCUMENTS

| | | | |
|---|---|---|---|
| DE | 102010034525 | A1 | 2/2011 |
| EP | 0849820 | A2 | 6/1998 |

(Continued)

OTHER PUBLICATIONS

Information about Related Patents and Patent Applications, see section 6 of the accompanying Information Disclosure Statement Letter, which concerns Related Patents and Patent Applications. Jan. 18, 2013.

(Continued)

*Primary Examiner* — Dieu H Duong
(74) *Attorney, Agent, or Firm* — Fox Rothschild LLP; Robert J. Sacco, Esq.

(57) ABSTRACT

Method for constructing a dipole radio frequency antenna includes depositing on a dielectric substrate at least one layer each of a conductive material, a dielectric material, and a sacrificial material. The deposit of conductive material is controlled to form a transmission line, antenna radiating element and associated antenna feed. The transmission line includes a shield formed of one or more walls and a center conductor disposed coaxially within the shield. An antenna feed portion is electrically connected to the center conductor and extends through a feed port on the transmission line to connect with an antenna radiating element. The radiating element has an elongated form which extends a first predetermined length transverse to an axis of the transmission line. The method also includes dissolving at least one layer of the sacrificial material to form a clearance space between the surface of the dielectric substrate and the antenna radiating element.

27 Claims, 6 Drawing Sheets

(56) References Cited

U.S. PATENT DOCUMENTS

| | | | |
|---|---|---|---|
| 2005/0001701 | A1 | 1/2005 | Shirakawa |
| 2005/0073380 | A1 | 4/2005 | Howell et al. |
| 2005/0190019 | A1 | 9/2005 | Metz |
| 2007/0018761 | A1 | 1/2007 | Yamanaka et al. |
| 2008/0142347 | A1 | 6/2008 | Lewis et al. |
| 2008/0164542 | A1 | 7/2008 | Yang et al. |
| 2010/0277259 | A1 | 11/2010 | Ahn et al. |
| 2011/0220472 | A1 | 9/2011 | Masuda et al. |
| 2013/0140165 | A1 | 6/2013 | Lin et al. |

FOREIGN PATENT DOCUMENTS

| | | | |
|---|---|---|---|
| EP | 1515390 | A1 | 3/2005 |
| EP | 1713144 | A1 | 10/2006 |
| EP | 1939974 | A1 | 7/2008 |
| EP | 2546920 | A1 | 1/2013 |
| ES | 2191642 | | 9/2003 |
| WO | 03/049514 | A2 | 6/2003 |
| WO | 2004/079795 | A2 | 9/2004 |
| WO | 2011/111274 | A1 | 9/2011 |

OTHER PUBLICATIONS

International Search Report and Written Opinion dated Dec. 20, 2013 issued in International Appln. No. PCT/US2013/056368 (12 pages).

Lau, N. U. and Sloan, R., Suspended Microstrip Patch Antenna With Ground-shield Tapered Suspended Stripline Feed, 33rd European Microwave Conference, Munich 2003, 1385-1387.

International Search Report and Written Opinion dated Jan. 16, 2014 issued in International Appln. No. PCT/US2013/06443 (12 pages).

International Search Report and Written Opinion mailed Nov. 28, 2013 for Interational Patent Appln. No. PCT/US2013/056316 to Harris Corporation (11 pages).

International Search Report and Written Opinion mailed Jan. 31, 2014 in International Patent Appln. No. PCT/US2013/065405 to Harris Corporation (9 pages).

* cited by examiner

WAFER-LEVEL RF TRANSMISSION AND RADIATION DEVICES

BACKGROUND OF THE INVENTION

1. Statement of the Technical Field

The inventive arrangements relate to wafer level RF devices and more particularly to radiation devices for microwave and millimeter wave communications.

2. Description of the Related Art

Many communication systems operate in high frequency bands. For example, communication systems operating at frequencies as high as 300 GHz are known. Radiation devices, namely antennas, are a necessary element in many such communications system for receiving and transmitting electromagnetic radiation. However, existing antennas for high frequencies (e.g. 10 GHz to 300 GHz) are known to suffer from certain limitations. For example conventional antennas designed for such frequencies are often based on thin film technology. Such designs tend to have relatively low power handling capability. Moreover, thin film designs with a relatively poor impedance match to transceiver circuitry may require additional matching networks can be needed for device optimization.

Three-dimensional microstructures can be formed by utilizing sequential build processes. For example, U.S. Pat. Nos. 7,012,489 and 7,898,356 describe methods for fabricating coaxial waveguide microstructures. These processes provide an alternative to traditional thin film technology, but also present new design challenges pertaining to their effective utilization for advantageous implementation of various RF devices.

SUMMARY OF THE INVENTION

The invention concerns a method for constructing a radio frequency antenna. The method includes depositing on a surface of a dielectric substrate a plurality of layers including at least one layer each of a conductive material, a dielectric material, and a sacrificial material. A deposit of at least one layer of conductive material is controlled to form a transmission line including a shield and a center conductor disposed coaxially within the shield, at least a first antenna radiating element external of the shield and of elongated form extending a first predetermined length and electrically connected to the center conductor. The deposit of the conductive material further includes forming a ground plane member electrically coupled to the shield and extending in a direction parallel to the elongated length within a near field of the first antenna radiating element. One or more layers of the sacrificial material are subsequently dissolved to form a channel disposed within the shield, including a first clearance space between the center conductor and each of one or more walls of the shield, whereby the center conductor resides in the channel spaced apart from the walls. This step also includes forming a second clearance space between the surface of the dielectric substrate and the first antenna radiating element.

The invention also concerns a radio frequency antenna assembly. The antenna assembly includes a dielectric substrate and a plurality of layers of conductive material disposed on the dielectric substrate. The plurality of layers are arranged in a stack to form a transmission line including a shield and a center conductor disposed coaxially within the shield. The layers also form at least a first antenna radiating element external of the shield and of elongated form extending a first predetermined length. The first antenna radiating element is electrically connected to the center conductor. A ground plane member is electrically coupled to the shield and extends in a direction parallel to the elongated length of the first antenna radiating element.

A sacrificial material is disposed between the surface of the dielectric substrate and the first antenna radiating element. A first plurality of tabs extend at spaced intervals from at least one of the substrate and the ground plane to the antenna radiating element. The tabs are configured to suspend the antenna radiating element over the surface of the dielectric substrate in the absence of the sacrificial material.

The invention also concerns a method for constructing a dipole radio frequency antenna. The method includes depositing on a surface of a dielectric substrate a plurality of layers including at least one layer each of a conductive material, a dielectric material, and a sacrificial material. A deposit of the at least one layer of conductive material is controlled to form a transmission line, antenna radiating element and associated antenna feed. The transmission line includes a shield formed of one or more walls and a center conductor disposed coaxially within the shield. The transmission line extends along a surface of the dielectric substrate. A feed port is provided on the transmission line and is comprised of an opening formed on a first wall of the transmission line opposed from the substrate. An antenna feed portion is electrically connected to the center conductor and extends through the feed port in a direction away from the surface. A first antenna radiating element is integral with the antenna feed portion and external of the shield. The first antenna radiating element has an elongated form which extends a first predetermined length transverse to an axis of the transmission line and is electrically connected to the antenna feed portion. The method also includes dissolving at least one layer of the sacrificial material to form a channel disposed within the at least one shield, including a first clearance space between the center conductor and each of one or more the walls of the shield whereby the center conductor resides in the channel spaced apart from the walls. The dissolving step also forms a second clearance space between the surface of the dielectric substrate and the first antenna radiating element.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1:
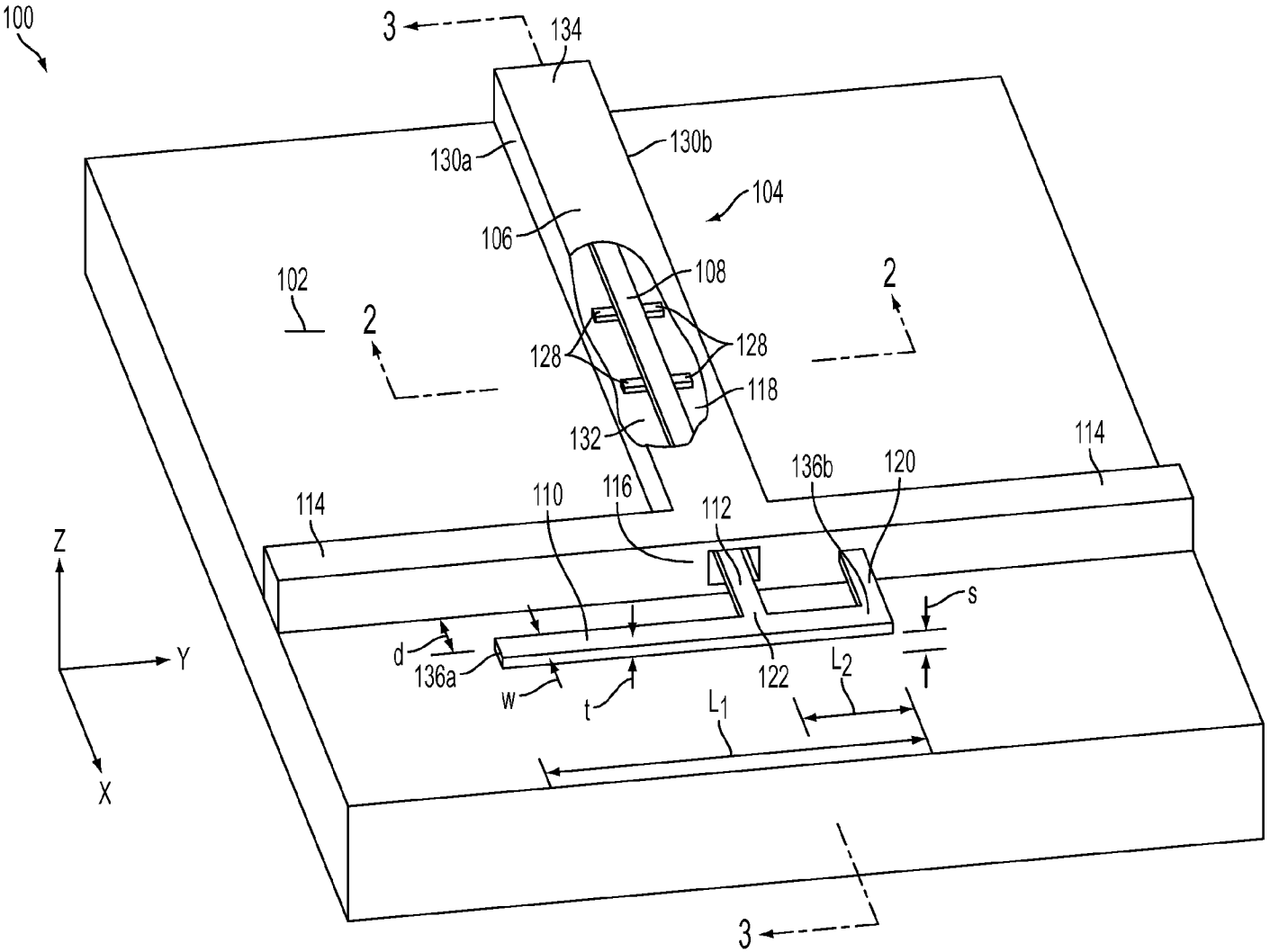
FIG. 1 is a perspective view of an antenna system that is useful for understanding the invention.

Referring now to FIG. 1 there is illustrated a perspective view of an antenna system 100 which is useful for understanding the invention. The antenna system is formed on a substrate 102. The substrate is formed from high-electrical-resistivity aluminum nitrate (AlN), or from other dielectric materials, such as silicon (Si), glass, silicon-germanium (SiGe), or gallium arsenide (GaAs). The antenna system includes an RF feed part which is comprised of a transmission line 104. The transmission line is of the coaxial variety including a shield 106 and a center conductor 108 which is disposed coaxially within the shield.

The transmission line 104 is configured to communicate RF energy to and from an antenna radiating element 110, which is external of the shield. A ground plane member 114 is electrically connected to the shield 106 and extends in a direction parallel to the elongated length of the antenna radiating element 110. The shield 106, center conductor 108, radiating element 110, and ground plane 114 are each formed of a highly conductive material such as copper (Cu). Of course, other conductive materials can be used for this purpose and the invention is not limited in this regard.

The radiating element 110 is suspended above the surface of the substrate 102. The radiating element is supported by the ground anchor 120 and feed portion 112 in some embodiments. With the foregoing arrangement, a clearance space is provided between the radiating element and the substrate. Similarly a clearance space is provided between the ground plane and the radiating element. This clearance space is filled with an air dielectric or some other gaseous dielectric. The air or other gaseous dielectric surrounding the antenna radiating element is advantageous as it can improve efficiency of the antenna system as compared to other such systems in which the antenna radiating element is disposed on the surface of a solid dielectric substrate.

The center conductor of transmission line 104 is advantageously suspended within an interior space 118 that defines a channel contained within the shield 106. For example, a plurality of tabs 128 can extend from side walls 130*a*, 130*b* for purposes of supporting the center conductor 108. As an alternative, or in addition to tabs 128, a plurality of tabs can extend vertically from a bottom wall 132 or top wall 134 to the center conductor 108 for purposes of suspending same within the interior space 118. According to a preferred embodiment, the tabs 128 are formed of an electrically insulating dielectric material. Acceptable dielectric materials for this purpose include polyethylene, polyester, polycarbonate, cellulose acetate, polypropylene, polyvinyl chloride, polyvinylidene chloride, polystyrene, polyamide, polyimide, and benzocyclobutene. Still, the invention is not limited in this regard and a wide variety of other dielectric materials can be acceptable for use in forming the tabs, provided that such materials are compatible with the manufacturing processes as hereinafter described.

In some embodiments, shield 106 has a cross-sectional profile that is rectangular as shown in FIG. 1. The center conductor 108 also can have a cross-sectional profile which is substantially rectangular. Accordingly, the transmission line 104 can have a rectangular-coaxial (recta-coax) structure. The rectangular profile described herein is preferred because it is well suited to the manufacturing processes which are described below in further detail. However, it should be understood that the invention is not limited in this regard. For example, the shield and/or the center conductor can have other cross-sectional profiles in some embodiments, and such alternative cross-sectional profiles are intended to be included in the scope of the present invention.

The dimensions of the shield 106, the dimensions of the center conductor 108, the spacing between the shield and the center conductor, and the type of gaseous dielectric contained within the shield can affect a characteristic impedance of the transmission line. Similarly, the cross-sectional profile of the shield and the cross-sectional profile of the center conductor can also affect the characteristic impedance of the transmission line 104. Accordingly, each of these variables can be selected by a designer to obtain a characteristic impedance for the transmission line which is desired for a particular application. For example, each of these variables can be selected by using conventional RF modeling software.

The transmission line includes a terminal end portion defined by a shield end face 116. It can be observed in FIG. 1 that the center conductor 108 transitions at the shield end face 116 from the interior space 118, which is inside the shield 106, to a space which is outside of the shield. A feed portion 112 of the center conductor provides an electrical connection between the center conductor and the antenna radiating element 110. The feed portion extends in a first direction that is generally aligned with a central axis of the transmission line 104 (at least in the area of the transmission line adjacent to the shield end face). This first direction is transverse to the plane defined by the shield end face. The feed portion 112 forms an electrical connection with the antenna radiating element at a feed point 122. In the embodiment of the invention shown in FIG. 1, this electrical connection occurs at an intermediate location between opposing ends 136*a*, 136*b* of the antenna radiating element. A ground anchor 120 connects one end of the antenna radiating element to the ground plane member 114. The combination of radiating element 110, feed portion 112 and ground anchor 120 together form an inverted F antenna configuration. In some embodiments of the invention, two or more elements of the structure described herein including the center conductor (including feed portion 112), antenna radiating element 110, ground anchor 120, and ground plane 114 can be integrally formed as a single unit using a process which is described below. In some embodiments, all of these elements can be integrally formed as part of a single common structure.

The antenna radiating element 110 extends a predetermined length $L_1$. The variable $L_1$ will generally have a value $\lambda > L_1 > \frac{1}{8}\lambda$, where $\lambda$ is the wavelength corresponding to the operating frequency for which the antenna is designed. For example, in an exemplary embodiment, the value of $L_1$ can be approximately $\frac{1}{4}\lambda$. Still, other values of $L_1$ are also possible. A distance between the ground anchor 120 and the feed point 122 is identified as $L_2$. A distance between the radiating element 110 and the ground plane 114 is defined by the variable d. A width and thickness of the antenna radiating element is defined by the variables "w" and "t" respectively.

A spacing between the surface of substrate 102 and the antenna radiating element is defined by the variable s.

The value of d is preferably selected so that the ground plane is positioned within a near field of the antenna radiating element, whereby the ground plane effectively functions as a reflector or counterpoise for the radiating element. Generally, this means that the ground plane member will be less than about ½λ distance from the antenna radiating element, but the invention is not limited in this regard. The values of w and t can be approximately consistent with the width and thickness of the center conductor 108 as shown, but other variations are also possible. Similarly, the spacing s between the substrate and the radiating element can be selected so that height of the radiating element is consistent with the height of the center conductor 108 as shown, but is not limited in this regard. In general, the values of d, t, w, s, $L_1$ and $L_2$ will depend on a variety of design factors including desired antenna pattern, efficiency, gain, and input impedance. Accordingly, these dimensions are preferably determined in accordance with conventional computer software applications which are available for modeling antennas and distributed elements in an RF system. Such systems are well known in the art and therefore will not be described here in detail. In general, however, the foregoing parameter values can be iteratively modified as needed until a desired combination of performance characteristics have been obtained.

The construction of the antenna system shown in FIG. 1 will now be described in further detail in relation to FIGS. 2 and 3. As illustrated therein, the transmission line 104 is disposed on substrate 102. The substrate can have a thickness, i.e., a "z" dimension, of approximately 0.005 inch. The shield 106 is formed from five layers of an electrically-conductive material such as copper (Cu). Each layer 154, 156, 160, 162, 164 can have a thickness of, for example, approximately 50 μm. The number of layers of the electrically-conductive material is application-dependent, and can vary with factors such as the complexity of the design, hybrid or monolithic integration of other devices with the antenna system, the overall height ("z" dimension) of the transmission line, the thickness of each layer, etc.

The first layer 154 of electrically-conductive material is disposed directly on the substrate 102 and forms the bottom wall of the shield. The sides 130*a*, 130*b* of the shield are formed by the second, third, and fourth layers 156, 160, 162 of electrically-conductive material. The fifth layer 164 of electrically-conductive material forms the top 134 of the shield. The center conductor 108 is formed by a portion of the third layer 160 of electrically conductive material.

A dielectric layer 158 forms the tabs 128 that are used for suspending the center conductor. The tabs 128 can each have a thickness of, for example, approximately 15 μm. Each tab spans the width, i.e., y-direction dimension, of the interior space 118. The ends of each tab are sandwiched between the second and third layers of electrically-conductive material. The respective widths, i.e., "x" or "y" dimensions, and the height, i.e., "z" dimension, of the shield 106 are selected so that the center conductor 108 is surrounded by, and is spaced apart from the interior surfaces of the shield 106 by an air gap or clearance space. The air gap is a dielectric that electrically isolates the center conductor 108 from the shield 106. Although referred to herein as an air gap, it should be understood that the space can also be filled with gaseous dielectrics other than air. This type of transmission-line configuration is commonly referred to as a "recta-coax" configuration, otherwise known as micro-coax.

Figure 3:
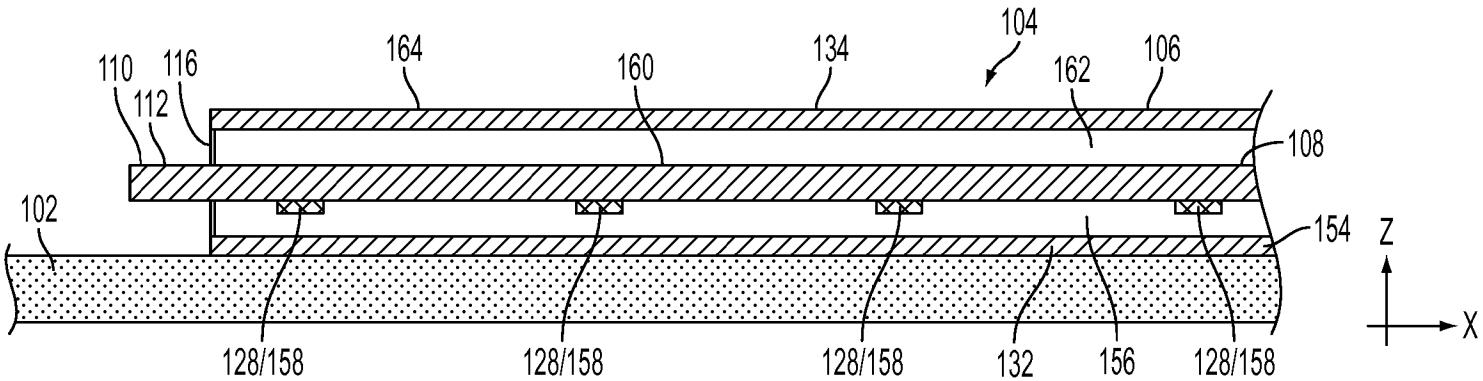
FIG. 3 is a cross-sectional view of the antenna system in FIG. 1, taken along line 3-3.

Referring now to FIG. 3, feed portion 112 and radiating element 110 are each formed by a portion of the third layer 160 of electrically conductive material. The tabs 128 can be formed from dielectric layer 158.

Figure 4:
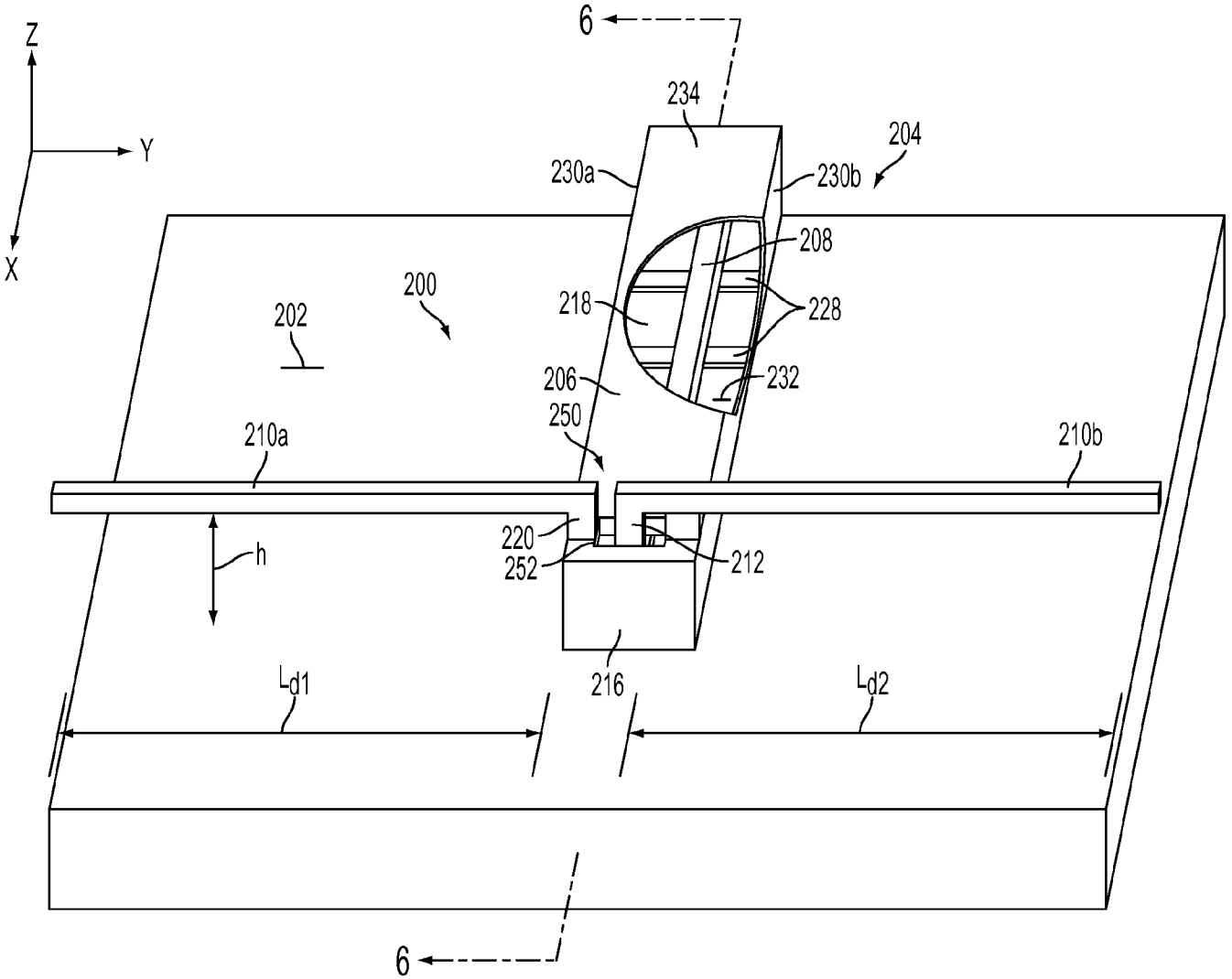
FIG. 4 is a perspective view of a second antenna system that is useful for understanding the invention.
Figure 5:
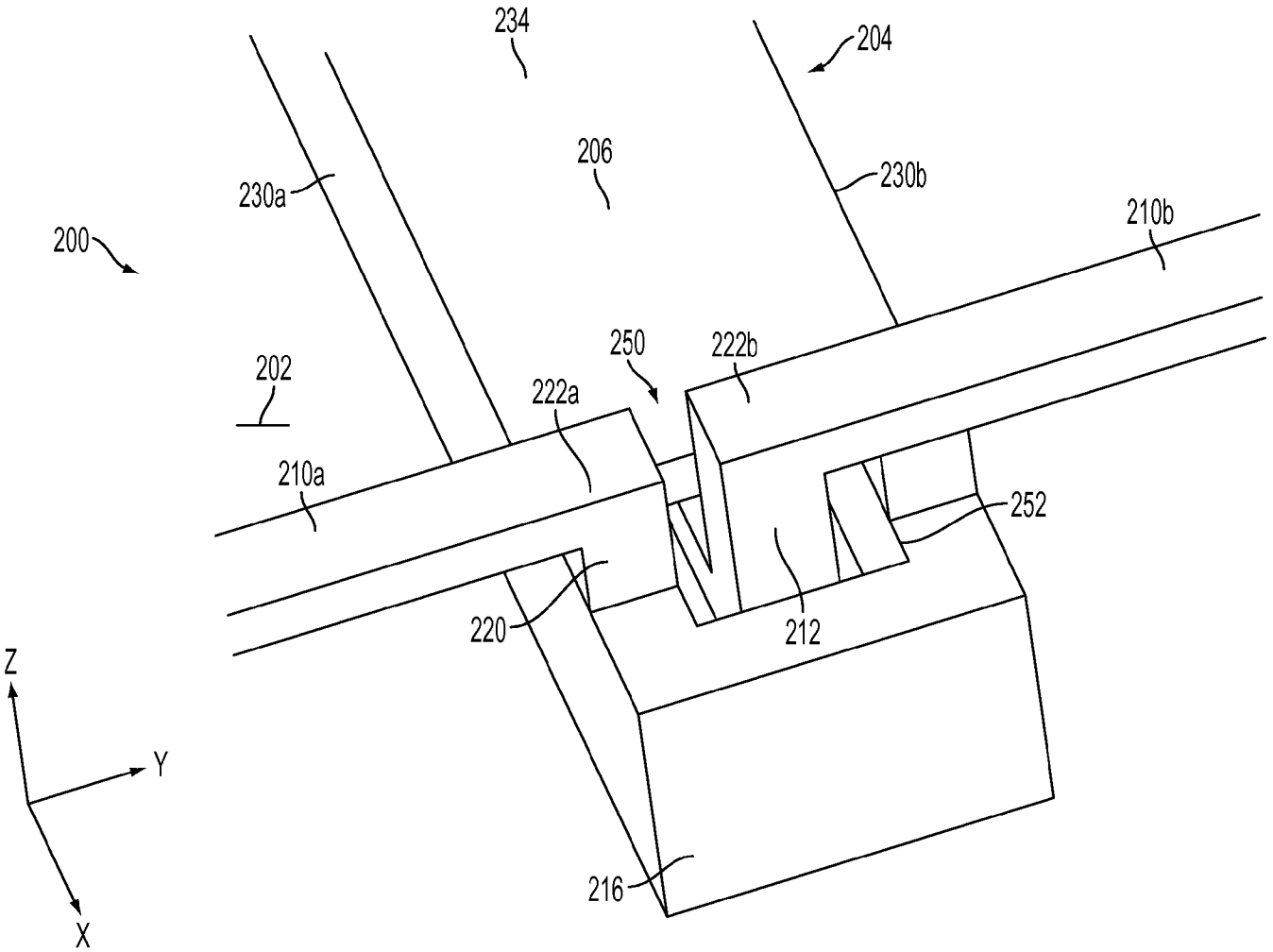
FIG. 5 is a perspective view of a portion of the second antenna system which is enlarged to show detail.
Figure 6:
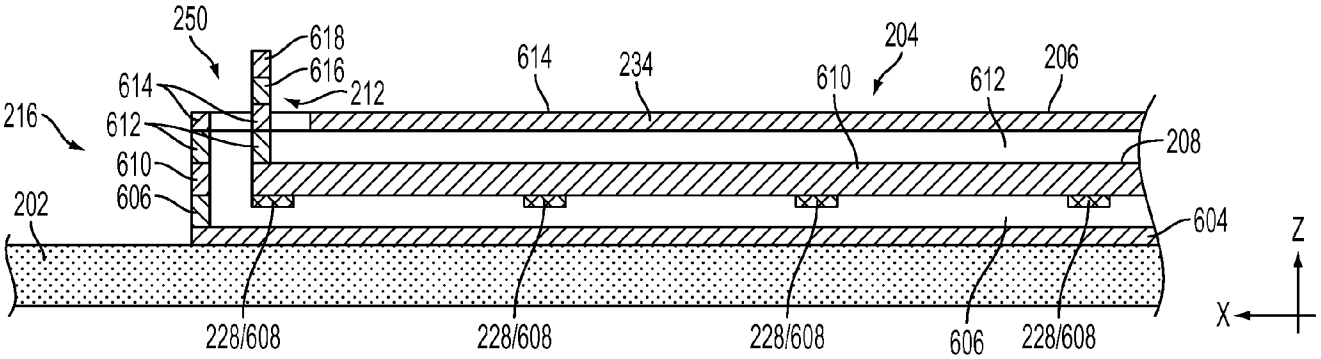
FIG. 6 is a cross-sectional view of the antenna system in FIG. 4, taken along line 6-6.

Referring now to FIG. 4-6 there are illustrated several views of a second antenna system 200 which is useful for understanding the invention. The antenna system is formed on a substrate 202. The substrate is comprised of a dielectric material such as silicon (Si) but can also be formed of other materials such as glass, silicon-germanium (SiGe), or gallium arsenide (GaAs). The antenna system includes an RF feed part 212 which is comprised of a transmission line 204. The transmission line is of the coaxial variety including a shield 206 and a center conductor 208 which is disposed coaxially within the shield.

The transmission line 204 is configured to communicate RF energy to and from antenna radiating elements 210*a*, 210*b*, which are external of the shield. The shield 206, center conductor 208, and radiating elements 210*a*, 210*b* are each formed of a highly conductive material such as copper (Cu). Of course, other conductive materials can be used for this purpose.

One or both of the radiating elements 210*a*, 210*b* are suspended above the surface of the substrate 202. With the foregoing arrangement, a clearance space is provided between the radiating elements and the substrate. This clearance space is filled with an air dielectric or some other gaseous dielectric. The air or other gaseous dielectric surrounding the antenna radiating elements is advantageous as it can improve efficiency of the antenna system as compared to other such systems in which the antenna radiating element is disposed on the surface of a solid dielectric substrate.

Figure 2:
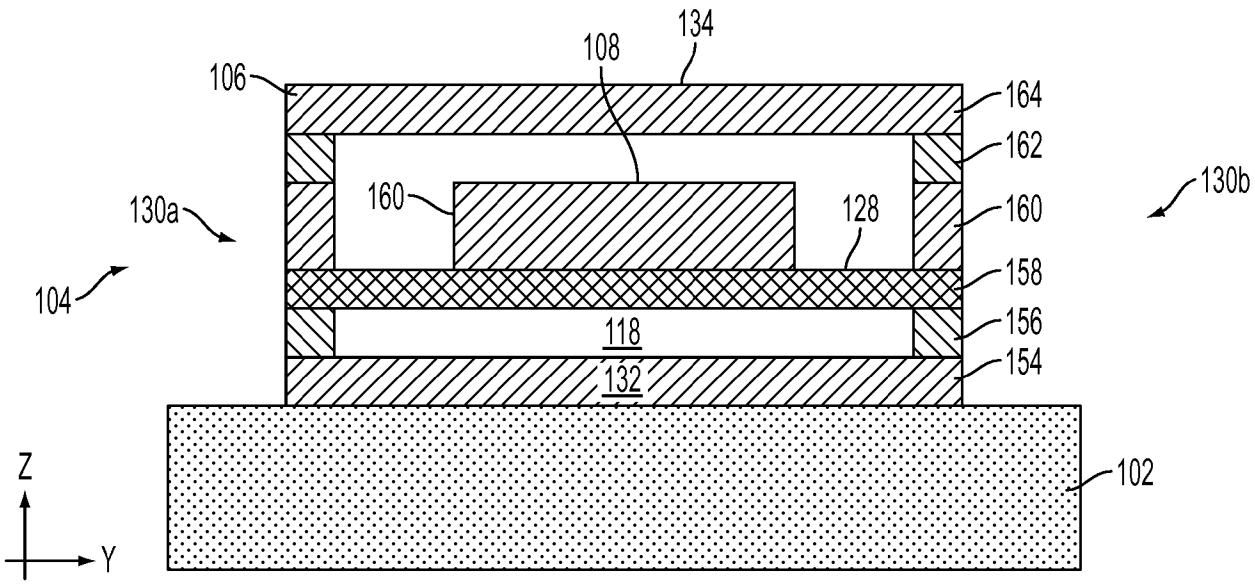
FIG. 2. is a cross-sectional view of the antenna system in FIG. 1, taken along line 2-2.

The transmission line 204 is similar to the transmission line 104 described in relation to FIG. 1-3. More particularly, the center conductor of transmission line 204 is advantageously suspended within an interior space 218 contained within the shield 206. For example, a plurality of tabs 228 can extend from side walls 230*a*, 230*b* for purposes of supporting the center conductor 208. As an alternative, or in addition to tabs 228, a plurality of tabs can extend vertically from a bottom wall 232 or top wall 234 to the center conductor 208 for purposes of suspending same within the interior space 218. According to a preferred embodiment, the posts tabs 228 are formed of an electrically insulating dielectric material. Acceptable dielectric materials for this purpose include polyethylene, polyester, polycarbonate, cellulose acetate, polypropylene, polyvinyl chloride, polyvinylidene chloride, polystyrene, polyamide, polyimide, and benzocyclobutene. Still, the invention is not limited in this regard and a wide variety of other dielectric materials can be acceptable for use in forming the tabs, provided that such materials are compatible with the manufacturing processes as hereinafter described.

In some embodiments, shield 206 has a cross-sectional profile that is rectangular. The center conductor 208 also can have a cross-sectional profile which is substantially rectangular. Accordingly, the transmission line 204 can have a rectangular-coaxial (recta-coax) structure. The center conductor/shield can have other cross-sectional profiles in some embodiments.

The transmission line includes a port located in a wall of the shield adjacent to a shield end face 216. For example, a port 250 is advantageously defined by an opening 252 formed in the top wall 234 as shown. The opening 252 preferably has a geometry that is consistent with the cross-sectional profile of the shield (e.g. a rectangular shape). The center conductor 208 transitions through the opening 252 from the interior space 218, which is inside the shield 206, to a space which is outside of the shield. More particularly, the center conductor extends in a direction which is generally transverse to the surface defined by substrate 202. A feed portion 212 of the center conductor provides an electrical connection between the center conductor 208 and the antenna radiating element 210*b*. The feed portion extends in a direction that is transverse to a central axis of the transmission line 204 (at least in the area of the transmission line adjacent to the shield end face). The feed portion 212 forms an electrical connection with a terminal end of the antenna radiating element 210*b* at a feed point 222*b*. A ground anchor 220 provides an electrical connection between radiating element 210*a* and the shield. In particular, the ground anchor extends from a feed point 222*a* to a peripheral edge of the opening 252. The combination of radiating element 210*a*, 210*b* form a dipole antenna.

The feed portion 212 and ground anchor 220 provide an RF feed arrangement for the dipole. In some embodiments of the invention, two or more elements of the antenna structure described herein including the center conductor (including feed portion 212), ground anchor 220, and antenna radiating elements 210*a*, 210*b*, can be integrally formed as a single unit using a process which is described below. In some embodiments, all of these elements can be integrally formed as part of a single unit.

The antenna radiating elements 210*a*, 210*b* can each extend a predetermined length $L_{d1}$, $L_{d2}$. In some embodiments, $L_{d1}$, $L_{d2}$ will each be approximately $\lambda/4$ where $\lambda$ is the wavelength corresponding to the operating frequency for which the antenna is designed. The resulting configuration is essentially a center fed dipole antenna. Still, the invention is not limited in this regard and other values $L_{d1}$, $L_{d2}$ are also possible. Also, it is possible for radiating element 210*a* to have a length that is different from radiating element 210*b* ($L_{d1} \neq L_{d2}$), such that the dipole is fed at a location which is offset to some extent from a central location defined as the medial point between the two opposing ends of the dipole elements 210*a*, 210*b*. Such a configuration is sometimes referred to as an off-center-fed (OCF) dipole. The radiating elements 210*a*, 210*b* can be positioned a height h above a surface of the substrate 202. The position of the radiating elements above the substrate provides a clearance space between the substrate and the radiating element.

In general, the values of h, $L_{d1}$, and $L_{d2}$ will depend on a variety of design factors including desired antenna pattern, efficiency, gain, and antenna input impedance. Accordingly, these dimensions are preferably determined in accordance with conventional computer software applications which are available for modeling antennas and distributed elements in an RF system. Such systems are well known in the art and therefore will not be described here in detail. In general, however, the foregoing parameter values can be iteratively modified as needed until a desired combination of performance characteristics have been obtained.

Transmission line 204 can have a construction similar to that described above with respect to transmission line 104, and can be formed from similar materials. As illustrated in FIG. 6, transmission line 204 is comprised of a five layers 604, 606, 610, 612 and 614 of electrically conductive material. The shield 206 and end face 216 are formed from layers 604, 606, 610, 612 and 614. The center conductor 208 is formed from layer 610. The feed portion 212 is formed from a layers 612, 614, and electrically conductive material layer 616. The ground anchor, which is not shown in FIG. 6, is also formed from layer 616. The antenna radiating elements 210*a*, 210*b* are formed of electrically conductive material layer 618. Tabs 228 are formed from a dielectric layer 608 which is sandwiched between layers 606 and 610.

Figure 7:
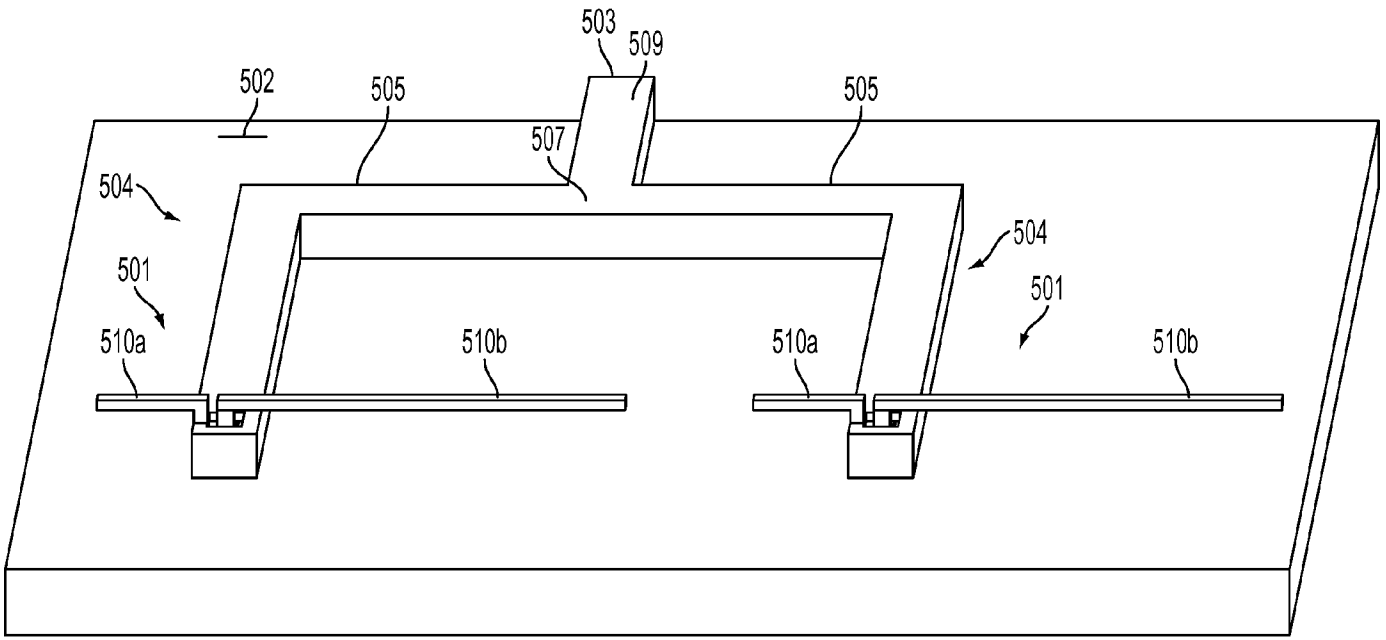
FIG. 7 is a perspective view of a third antenna system which incorporated certain features of the antenna system shown in FIG. 4.

Referring now to FIG. 7, there is shown an antenna array 500 in which a plurality of antenna systems 501 are used in combination. Each of the antenna systems 501 is similar to antenna system 200. As such, the discussion above is sufficient for understanding the structure and features of antenna systems 501 (including transmission lines 504). In the exemplary arrangement shown in FIG. 7, antenna elements 510*a*, 510*b* have respective lengths that are unequal. Still, it should be appreciated that the invention is not limited in this regard and equal length transmission lines are also possible.

Figure 8:
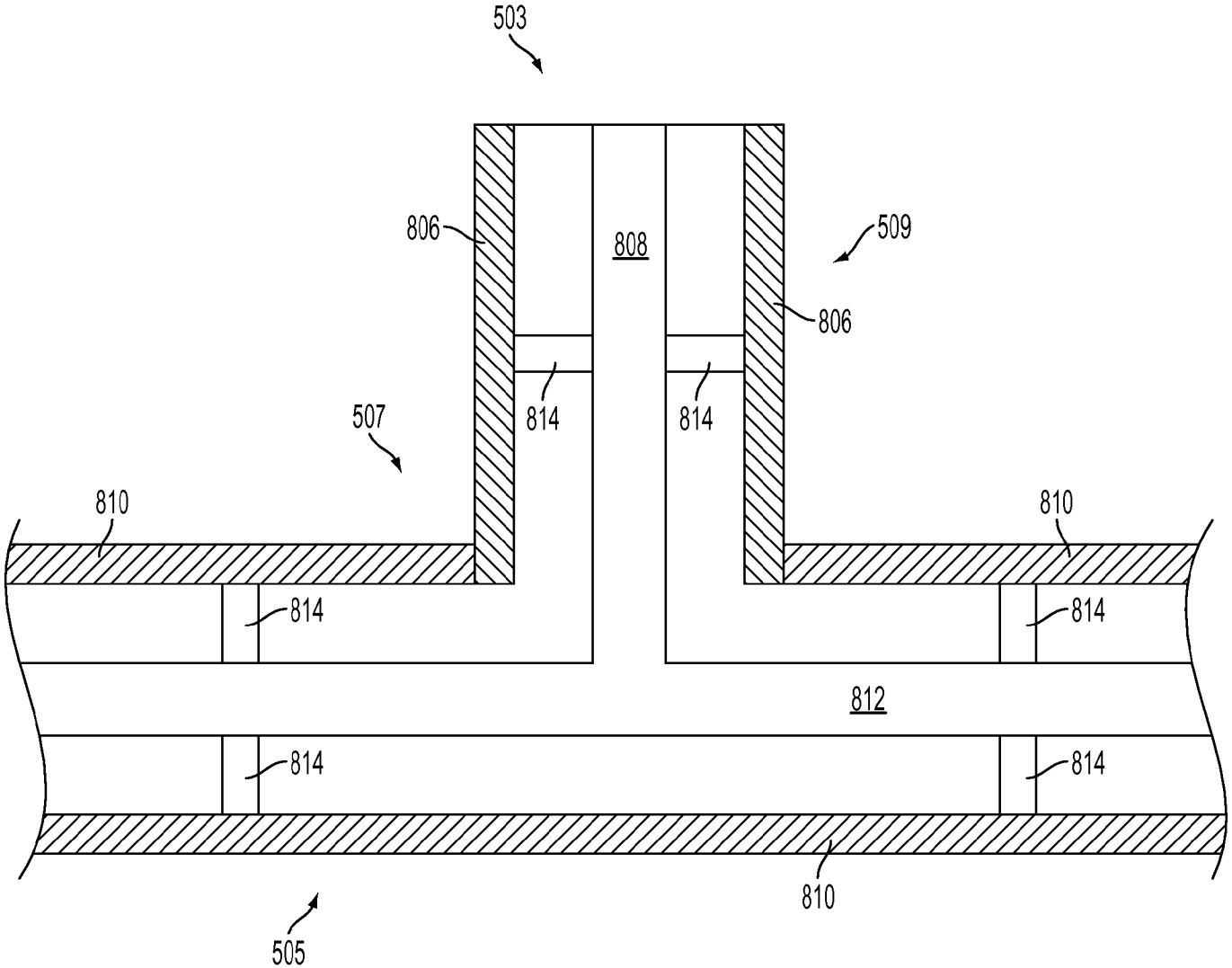
FIG. 8 is a cross-sectional view of a divider/combiner used in the antenna system of FIG. 7.

RF energy is communicated to and from the antenna systems 501 by way of an array feed port 503 and transmission lines 504, 505, and 509. A signal divider/combiner 507 allows an RF signal communicated from feed port 503 to be divided into two RF signals, each having approximately equal power levels. These two RF signals are then communicated to antenna systems 501 by means of transmission lines 504 and 505. Notably, transmission lines 504, 505 and 509 can each have a structure that is similar to transmission line 204. As shown in FIG. 8, the center conductors 808, 812 of each transmission line can be suspended by tabs in a manner similar to transmission line 204. Specifically, center conductors are respectively suspended within an interior of shield 806, 810 by dielectric tabs 814. With the foregoing arrangement, there is an air gap or clearance space between each shield and its associated center conductor. The clearance space is preferably filled with air or some other type of gaseous dielectric. A characteristic impedance of the transmission lines 505, 509 can be determined by a variety of factors. For example, these factors can include the dimensions of the shields 806, 810, the dimensions of the center conductor 808, 812, the spacing between the shields and their respective center conductor, and the type of gaseous dielectric contained within the shield. Similarly, the cross-sectional profile of the shields and the cross-sectional profiles of the center conductor can also affect the characteristic impedance of the transmission lines. Accordingly, each of the foregoing variables can be selected by a designer to obtain a characteristic impedance for the transmission line which is desired for a particular application. For example, each of these variables can be selected by using conventional RF modeling software. As will be appreciated by those skilled in the art, the antenna feed system comprised of transmission lines 504, 505, 509 and divider/combiner 507 is bi-directional such that RF signals received at antenna systems 501 are combined at divider/combiner 507 and communicated to port 503.

Any suitable arrangement can be used for implementing the divider/combiner 507. However, in a preferred embodiment, the divider/combiner can have an arrangement similar to that shown in FIG. 8. As illustrated therein, transmission lines 505 and 509 can be arranged in T-configuration. More particularly, each of center conductors 808, 812, and shields 806, 810 can form a T-configuration as shown.

The construction of the transmission lines 504, 505, and 509 is similar to that of transmission lines 104 and 204. The construction of the antenna radiating elements, feed portion, ground anchor and dielectric similar is to the arrangement described above with respect to antenna system 200 in FIG. 6.

The antenna systems described herein with respect to FIGS. 1-8 can be manufactured using known processing techniques for creating three-dimensional microstructures, including coaxial transmission lines. For example, suitable processing techniques applicable to the fabrication of the structures described herein are described in U.S. Pat. Nos. 7,898,356 and 7,012,489, the disclosure of which is incorporated herein by reference. In general, such processing involves depositing a layer of photoresist material to the upper surface of the substrate 102/202/502, so that the only exposed portions of the upper surface correspond to the locations of the various components of the antenna system that are to be disposed directly on the substrate. The electrically-conductive material, e.g., Cu, is subsequently deposited on the unmasked or exposed portions of the substrate to a predetermined thickness, to form the first layer of the electrically-conductive material Another photoresist layer is subsequently applied to the partially-constructed system by patterning additional photoresist material over the partially-constructed system, and over the previously-applied photoresist layer, so that the only exposed areas on the partially-constructed system correspond to the locations at which the various portions of the second layer of the system are to be located. The electrically-conductive material is subsequently deposited on the exposed portions of the system to a predetermined thickness, to form the second layer of the electrically-conductive material. The remaining layers are subsequently formed in substantially the same manner. When appropriate, dielectric layers are deposited instead of electrically conductive material. Once the final layer has been formed, the photoresist material remaining from each of the masking steps can be released or otherwise removed, using a suitable technique such as exposure to an appropriate solvent that dissolves the photoresist material.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

We claim:

1. A method for constructing a radio frequency antenna, comprising:

depositing on a surface of a dielectric substrate a plurality of layers including at least one layer each of a conductive material, a dielectric material, and a sacrificial material;

controlling a deposit of said at least one layer of conductive material to form:

a transmission line including a shield and a center conductor disposed coaxially within said shield, a first antenna radiating element external of said shield and of elongated form extending a first predetermined length and electrically connected to said center conductor, and a ground plane member electrically coupled to said shield and extending in a direction parallel to said elongated length within a near field of said first antenna radiating element; and dissolving said at least one layer of said sacrificial material to form:

a channel disposed within said at least one shield, including a first clearance space between said center conductor and each of one or more walls of said shield, whereby said center conductor resides in said channel spaced apart from said walls, and a second clearance space between said surface of said dielectric substrate and said first antenna radiating element.

2. The method according to claim 1, further comprising controlling a deposit of said at least one layer of dielectric material to form a first plurality of tabs extending from at least one of said substrate and said ground plane to said antenna radiating element and suspending said antenna radiating element over said surface of said dielectric substrate.

3. The method according to claim 2, further comprising controlling said deposit of said at least one layer of dielectric material to position each of said first plurality of tabs at spaced intervals along said elongated length of said first antenna radiating element.

4. The method according to claim 3, wherein said dissolving step further comprises dissolving said sacrificial material between adjacent ones of said first plurality of tabs.

5. The method according to claim 1, wherein said dissolving step includes forming a third clearance space between said first antenna radiating element and said ground plane member.

6. The method according to claim 1, wherein said controlling step further comprises forming a terminal end portion of said transmission line defined by a shield end face and a feed portion of said center conductor which extends external of said shield at said shield end face.

7. The method according to claim 6, wherein said controlling step further comprises forming an electrical connection between said first antenna radiating element and said center conductor at an end of said feed portion external of said shield and distal from said shield end face.

8. The method according to claim 7, wherein said controlling step further comprises forming said electrical connection at an intermediate location between opposing ends of said first antenna radiating element.

9. The method according to claim 8, wherein said controlling step further comprises forming a ground anchor extending from said ground plane to one of said opposing ends of said first antenna radiating element.

10. The method according to claim 7, wherein said controlling step further comprises causing said feed portion to extend in a first direction transverse to said shield end face, and causing said first antenna radiating element to extend in a second direction transverse to said first direction.

11. The method according to claim 7, wherein said controlling step further comprises forming a second radiating element approximately equal in length to said first radiating element.

12. The method according to claim 11, wherein said controlling step further comprises causing said second radiating element to extend in a direction substantially opposed to said first radiating element to form a dipole antenna.

13. The method according to claim 12, wherein said dissolving step further comprises forming a third clearance space between said surface of said dielectric substrate and said second antenna radiating element.

14. A radio frequency antenna assembly, comprising:

a dielectric substrate;

a plurality of layers of conductive material disposed on said dielectric substrate and arranged in a stack to form:

a transmission line including a shield and a center conductor disposed coaxially within said shield;

a first antenna radiating element external of said shield and of elongated form extending a first predetermined length and electrically connected to said center conductor;

a ground plane member electrically coupled to said shield and extending in a direction parallel to said elongated length within a near field of said first antenna radiating element;

a sacrificial material disposed between said surface of said dielectric substrate and said first antenna radiating element; and a first plurality of tabs extending at spaced intervals from at least one of said substrate and said ground plane to said antenna radiating element, said plurality of tabs configured to suspend said antenna radiating element over said surface of said dielectric substrate in the absence of said sacrificial material.

15. The radio frequency antenna according to claim 14, wherein said sacrificial material is further disposed within a second clearance space between said center conductor and each of one or more walls of said shield.

16. The radio frequency antenna according to claim 14, further comprising:

a terminal end portion of said transmission line defined by a shield end face; and a feed portion of said center conductor which extends external of said shield at said shield end face.

17. The radio frequency antenna according to claim 16, wherein said first antenna radiating element is electrically connected to said center conductor at an end of said feed portion external of said shield and distal from said shield end face.

18. The radio frequency antenna according to claim 17, wherein said electrical connection is at an intermediate location between opposing ends of said first antenna radiating element.

19. The radio frequency antenna according to claim 18, further comprising a ground anchor extending from said ground plane to one of said opposing ends of said first antenna radiating element.

20. The radio frequency antenna according to claim 17, wherein said feed portion extends in a first direction transverse to said shield end face, and said first antenna radiating element extend in a second direction transverse to said first direction.

21. The radio frequency antenna according to claim 17, further comprising a second radiating element approximately equal in length to said first radiating element.

22. The radio frequency antenna according to claim 21, wherein said second radiating element extends in a direction substantially opposed to said first radiating element to form a dipole antenna.

23. A method for constructing a radio frequency antenna, comprising:

depositing on a surface of a dielectric substrate a plurality of layers including at least one layer each of a conductive material, a dielectric material, and a sacrificial material;

controlling a deposit of said at least one layer of conductive material to form:

a transmission line including a shield formed of one or more walls and a center conductor disposed coaxially within said shield and extending along a surface of said dielectric substrate;

a feed port comprising an opening formed on a first wall of said transmission line opposed from said substrate;

an antenna feed portion electrically connected to said center conductor and extending through said feed port in a direction away from said surface;

a first antenna radiating element integral with said antenna feed portion and external of said shield, said first antenna radiating element having an elongated form extending a first predetermined length transverse to an axis of said transmission line and electrically connected to said antenna feed portion; and dissolving said at least one layer of said sacrificial material to form:

a channel disposed within said at least one shield, including a first clearance space between said center conductor and each of one or more said walls of said shield, whereby said center conductor resides in said channel spaced apart from said walls, and a second clearance space between said surface of said dielectric substrate and said first antenna radiating element.

24. The method according to claim 23, wherein said controlling step further comprises forming a ground anchor and second antenna radiating element integral with and electrically connected to said shield.

25. The method according to claim 24, wherein said second antenna radiating element has an elongated form extending a second predetermined length transverse to an axis of said transmission line.

26. The method according to claim 23, wherein said radio frequency antenna is a first radio frequency antenna, and further comprising concurrently forming with said depositing, controlling and dissolving steps a second radio frequency antenna equivalent to said first radio frequency antenna.

27. The method according to claim 26, further comprising forming with said depositing, controlling and dissolving steps at least one RF frequency divider/combiner coupled to each of said first and second radio frequency antenna.

* * * * *